US012429236B2

(12) United States Patent
Shen et al.

(10) Patent No.: US 12,429,236 B2
(45) Date of Patent: Sep. 30, 2025

(54) MOTOR SUPPORT AND DEHUMIDIFIER HAVING SAME

(71) Applicant: GD MIDEA AIR-CONDITIONING EQUIPMENT CO., LTD., Foshan (CN)

(72) Inventors: Wenjun Shen, Foshan (CN); Zhigang Xing, Foshan (CN); Yu Liu, Foshan (CN); Zhisheng Lei, Foshan (CN); Kangwen Zhang, Foshan (CN); Yuhang Tang, Foshan (CN); Peili Dong, Foshan (CN); Chengli Yang, Foshan (CN)

(73) Assignee: GD MIDEA AIR-CONDITIONING EQUIPMENT CO., LTD., Foshan (CN)

( * ) Notice: Subject to any disclaimer, the term of this patent is extended or adjusted under 35 U.S.C. 154(b) by 678 days.

(21) Appl. No.: 17/431,338

(22) PCT Filed: Dec. 21, 2020

(86) PCT No.: PCT/CN2020/137937
§ 371 (c)(1),
(2) Date: Aug. 16, 2021

(87) PCT Pub. No.: WO2022/021764
PCT Pub. Date: Feb. 3, 2022

(65) Prior Publication Data

US 2022/0307706 A1 Sep. 29, 2022

(30) Foreign Application Priority Data

Jul. 31, 2020 (CN) ..... 202021576813.2
Jul. 31, 2020 (CN) ..... 202021577158.2
(Continued)

(51) Int. Cl.
*F24F 3/14* (2006.01)
*F04D 29/66* (2006.01)
(Continued)

(52) U.S. Cl.
CPC ..... *F24F 3/1405* (2013.01); *F04D 29/668* (2013.01); *F24F 13/20* (2013.01);
(Continued)

(58) Field of Classification Search
CPC ..... F24F 3/1405; F24F 13/20; F24F 13/222; F24F 13/28; F24F 13/30; F24F 2013/205;
(Continued)

(56) References Cited

U.S. PATENT DOCUMENTS 4,712,382 A 12/1987 Leclear et al.
7,448,224 B2 * 11/2008 Wu ..... B01D 53/265 62/298
(Continued)

FOREIGN PATENT DOCUMENTS

CN 204513599 U 7/2015
CN 205641464 U 10/2016
(Continued)

OTHER PUBLICATIONS

The European Patent Office (EPO) Extended Search Report for EP Application No. 20922477.3 Apr. 12, 2022 9 Pages.
(Continued)

*Primary Examiner* — Gene O Crawford
(74) *Attorney, Agent, or Firm* — Anova Law Group, PLLC

(57) ABSTRACT

A motor support includes a support body and a mounting rack. The mounting rack is hung below the support body by a connection member and is configured to mount a motor.

19 Claims, 14 Drawing Sheets

(30) Foreign Application Priority Data

Nov. 12, 2020 (CN) ..... 202011262680.6
Nov. 12, 2020 (CN) ..... 202022616572.6

(51) Int. Cl.
*F24F 13/20* (2006.01)
*F24F 13/22* (2006.01)
*F24F 13/28* (2006.01)
*F24F 13/30* (2006.01)

(52) U.S. Cl.
CPC ..... *F24F 13/222* (2013.01); *F24F 13/28* (2013.01); *F24F 13/30* (2013.01); *F24F 2013/205* (2013.01)

(58) Field of Classification Search
CPC ..... F24F 1/0358; F24F 11/89; F24F 13/22; F04D 29/668
USPC ..... 248/213.3, 213.4, 232, 233, 234, 671, 248/672, 674, 675, 676
See application file for complete search history.

(56) References Cited

U.S. PATENT DOCUMENTS

| | | | | |
|---|---|---|---|---|
| 7,752,861 | B2 * | 7/2010 | Ishihara | F24F 1/56 248/676 |
| 8,347,640 | B2 * | 1/2013 | DeMonte | F24F 3/153 62/93 |
| 8,851,863 | B2 * | 10/2014 | Etter | F04D 29/624 248/676 |
| 8,858,198 | B1 * | 10/2014 | Kopel | F04D 29/703 417/372 |
| 9,205,374 | B2 * | 12/2015 | Black | B01D 53/265 |
| 9,416,985 | B2 * | 8/2016 | Tom | F04D 25/088 |
| 9,879,878 | B2 * | 1/2018 | Lee | F24F 3/14 |
| 10,753,625 | B2 * | 8/2020 | Williams | F24F 13/20 |
| 10,921,002 | B2 * | 2/2021 | Dingle | F25B 6/04 |
| 2001/0037630 | A1 | 11/2001 | Eom | |
| 2002/0134099 | A1 * | 9/2002 | Mochizuki | F24F 13/222 62/507 |
| 2006/0054712 | A1 * | 3/2006 | Wu | F24F 13/30 236/44 A |
| 2010/0275630 | A1 * | 11/2010 | DeMonte | F24F 1/04 62/272 |
| 2015/0276241 | A1 * | 10/2015 | Jeon | F24F 3/1405 62/126 |
| 2018/0290103 | A1 * | 10/2018 | Choi | B01D 53/265 |
| 2019/0137121 | A1 * | 5/2019 | Swanson | F24F 1/028 |
| 2019/0137124 | A1 * | 5/2019 | Mcgarva | F24F 13/0272 |
| 2020/0061532 | A1 * | 2/2020 | Yoon | F24F 13/222 |
| 2020/0271336 | A1 * | 8/2020 | Huang | F24F 3/14 |

FOREIGN PATENT DOCUMENTS

| | | | |
|---|---|---|---|
| CN | 206018859 | U | 3/2017 |
| CN | 107449059 | A | 12/2017 |
| CN | 108224597 | A | 6/2018 |
| CN | 109724163 | A | 5/2019 |
| CN | 209689080 | U | 11/2019 |
| CN | 111156617 | A | 5/2020 |
| CN | 111720893 | A | 9/2020 |
| CN | 214249894 | U | 9/2021 |
| JP | H10148363 | A | 6/1998 |
| JP | H1183073 | A | 3/1999 |
| JP | 2003130442 | A | 5/2003 |
| JP | 2008202891 | A | 9/2008 |
| JP | 2009168437 | A | 7/2009 |
| KR | 20060082335 | A | 7/2006 |
| KR | 20190139054 | A | 12/2019 |

OTHER PUBLICATIONS

World Intellectual Property Organization (WIPO) International Search Report for PCT/CN2020/137937 Apr. 1, 2021 9 pages (with translation).
China National Intellectual Property Administration (CNIPA) Office Action 1 for Application No. 202011262680.Nov. 6, 27, 2024 21 Pages (including translation).

* cited by examiner

MOTOR SUPPORT AND DEHUMIDIFIER HAVING SAME

CROSS-REFERENCE TO RELATED APPLICATIONS

The present application is a National Stage Entry under 35 U.S.C. § 371 of International Application No. PCT/CN2020/137937, filed on Dec. 21, 2020, which is based on and claims priority to Chinese Patent Application Nos. 202021577158.2 and 202021576813.2, filed on Jul. 31, 2020, and Chinese Patent Application Nos. 202011262680.6 and 202022616572.6, filed on Nov. 12, 2020, the entire contents of all of which are incorporated herein by reference.

FIELD

The present application relates to the motor mounting technical field, and particularly to a motor support and a dehumidifier having the same.

BACKGROUND

Generally, a motor of a fan of a dehumidifier is fixedly supported by a motor support. In the related art, in order to reliably support the motor, a support pillar of the motor support generally has a larger diameter than the motor, and is located at a lower portion, and the motor is provided at the support pillar, such that the motor support may block air, resulting in reduction of an air volume; in order to guarantee a certain air volume, a high-power high-rotation-speed motor is required to be provided with a large-diameter fan blade to improve the air volume; however, this arrangement may increase power consumption and reduce an energy efficiency ratio of the dehumidifier, and is unable to realize energy conservation.

SUMMARY

The present application seeks to solve at least one of the problems existing in the related art. To this end, the present application provides a motor support which may realize suspension of a motor, and is favorable to guaranteeing an air volume and reducing power consumption.

A motor support according to a first aspect of the present application includes: a support body; and a mounting rack hung below the support body by a connection member and configured to mount a motor.

In the motor support according to the present application, the motor may be suspended by hanging the mounting rack below the support body by the connection member; and when the motor support is configured to mount the motor of a fan, positions, such as an air inlet side, or the like, of the fan are conveniently prevented from being blocked by a partial structure of the motor support, thereby reducing resistance encountered in an air flowing process, reducing the power consumption while guaranteeing the air volume, facilitating achievement of a high energy efficiency, and meanwhile guaranteeing a sound quality of a product.

In some embodiments, the support body extends to have a closed loop shape or open loop shape.

In some embodiments, the connection member includes a plurality of connection arms arranged at intervals along a circumferential direction of the support body.

In some embodiments, the motor support further includes a pillar configured to support a bottom of the support body.

In some embodiments, the motor support is used in a dehumidifier, the motor of the fan of the dehumidifier is configured to be mounted at the mounting rack, an evaporator of the dehumidifier is configured to be supported at a lower side of the support body, an upper surface of the support body is provided with at least one of a convex rib or a drainage hole, the convex rib is configured to abut against a housing of the dehumidifier, and the drainage hole runs through the support body in an up-down direction; and/or a condenser of the dehumidifier is configured to be supported at the lower side of the support body, and a stopper is formed at the support body and configured to abut against the condenser.

In some embodiments, when the stopper is formed at the support body, the stopper includes: a first stop member configured to abut against one side of the condenser in a width direction; and/or a second stop member configured to abut against one side of the condenser in a height direction.

In some embodiments, when the stopper is formed at the support body, there are a plurality of stoppers, and the plurality of stoppers are configured to be arranged at intervals along a length direction of the condenser.

In some embodiments, the connection member includes a plurality of connection arms arranged at intervals along an extension direction of the support body, and an end of at least one of the connection arms connected to the support body has two sides in the length direction of the condenser provided with the stoppers respectively.

A dehumidifier according to a second aspect of the present application includes: a housing, an air inlet being provided at the housing; a water pan provided in the housing; a motor support according to the above-mentioned first aspect of the present application, the motor support being provided in the housing, the support body being provided above the water pan, the mounting rack being located between the support body and the water pan in the up-down direction, and a motor of a fan of the dehumidifier being mounted at the mounting rack.

In the dehumidifier according to the present application, the adoption of the above-mentioned motor support is favorable to guaranteeing the air volume of the dehumidifier and reducing the power consumption, and facilitates achievement of the high energy efficiency.

In some embodiments, a heat exchanger assembly is provided in the housing, the heat exchanger assembly is provided at the water pan and between the water pan and the support body, the heat exchanger assembly includes a heat exchanger and two side plates, the heat exchanger includes an evaporator and a condenser sequentially arranged from inside to outside, the two side plates are provided at two ends of the heat exchanger respectively and fixedly connected to the water pan, the support body is supported at a top of the heat exchanger and fixedly connected to the two side plates respectively, and the condenser is located downstream of the evaporator in an airflow direction.

In some embodiments, the heat exchanger assembly includes a first heat exchanging part, a second heat exchanging part and a third heat exchanging part arranged along a circumferential direction of the housing, the first heat exchanging part is arranged opposite to the third heat exchanging part, the second heat exchanging part is connected between the first and third heat exchanging parts, one of the two side plates is provided at an end of the first heat exchanging part away from the second heat exchanging part, the other side plate is provided at an end of the third heat exchanging part away from the second heat exchanging part, the motor support further includes a pillar provided between the support body and the water pan for support, and the pillar and the side plates are located at two opposite ends of the support body respectively.

In some embodiments, the dehumidifier further includes a filter screen assembly covering the air inlet, a first guide groove is formed at the motor support, a second guide groove is formed at the water pan, and both ends of the filter screen assembly pass through one length end of the first guide groove and one length end of the second guide groove respectively, and may be drawably inserted into the first and second guide grooves.

In some embodiments, the first guide groove is formed at the support body.

In some embodiments, the first guide groove has a depth $t_1$, the second guide groove has a depth $t_2$, $t_1>5$ mm, and $t_2>5$ mm.

In some embodiments, the filter screen assembly includes a filter screen and a filter screen skeleton, the filter screen is provided at the filter screen skeleton and covers the air inlet, the filter screen skeleton is drawably inserted into the first and second guide grooves, the first guide groove has a width $d_1$, the second guide groove has a width $d_2$, the part of the filter screen skeleton inserted into the first guide groove has a width $d_1'$, the part of the filter screen skeleton inserted into the second guide groove has a width $d_2'$, 1 mm$\leq d_1-d_1'\leq 2$ mm, and 1 mm$\leq d_2-d_2'\leq 2$ mm.

In some embodiments, there are three air inlets, the three air inlets are arranged along the circumferential direction of the housing, a heat exchanger assembly is further provided in the housing, is located downstream of the filter screen assembly in the airflow direction, extends along the circumferential direction of the housing, and is provided opposite to the three air inlets, and the first and second guide grooves both extend along the circumferential direction of the housing, and are provided opposite to the three air inlets.

Additional aspects and advantages of the present application will be given in part in the following descriptions, become apparent in part from the following descriptions, or be learned from the practice of the embodiments of the present application.

BRIEF DESCRIPTION OF THE DRAWINGS

The above and/or additional aspects and advantages of the present application will become apparent and more readily appreciated from the following descriptions made with reference to the drawings, in which.

REFERENCE NUMERALS

Figure 1:
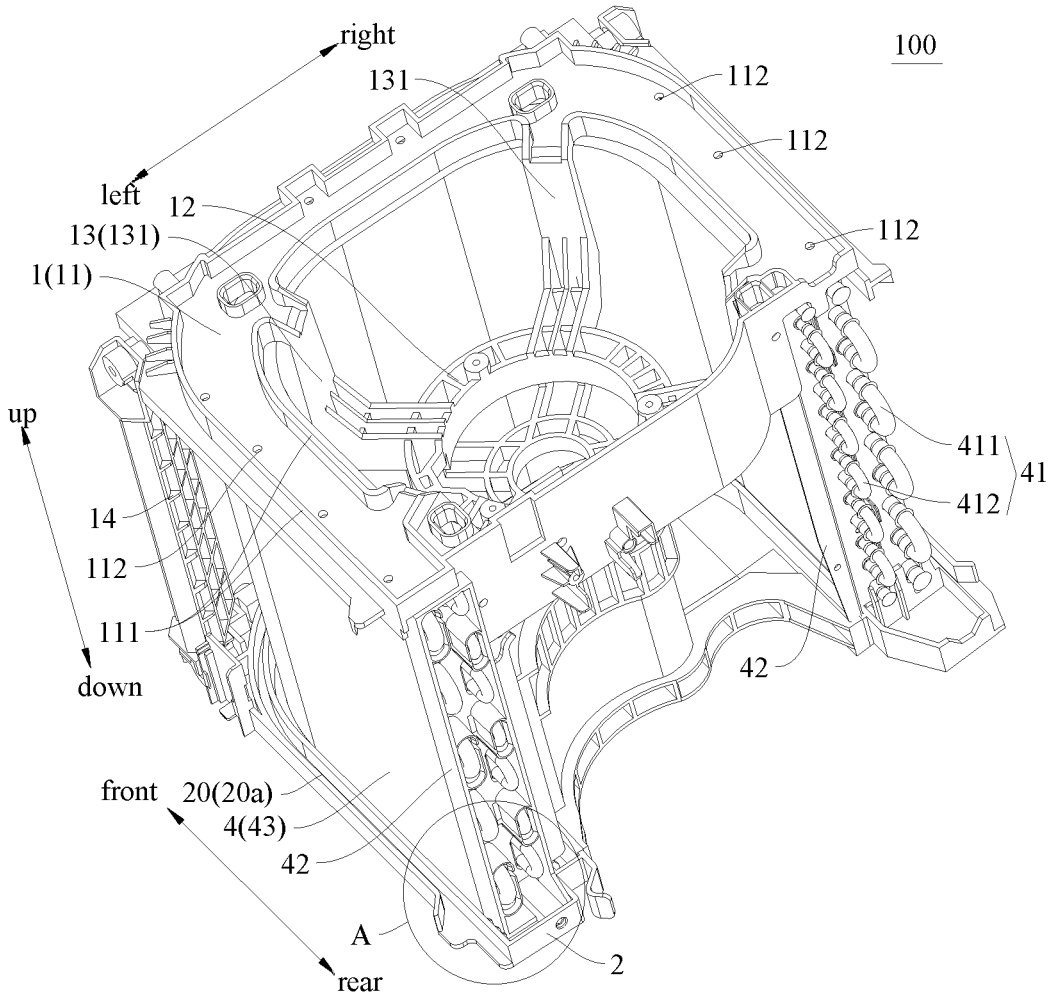
FIG. 1 is a schematic diagram of a dehumidifier according to one embodiment of the present application.
Figure 2:
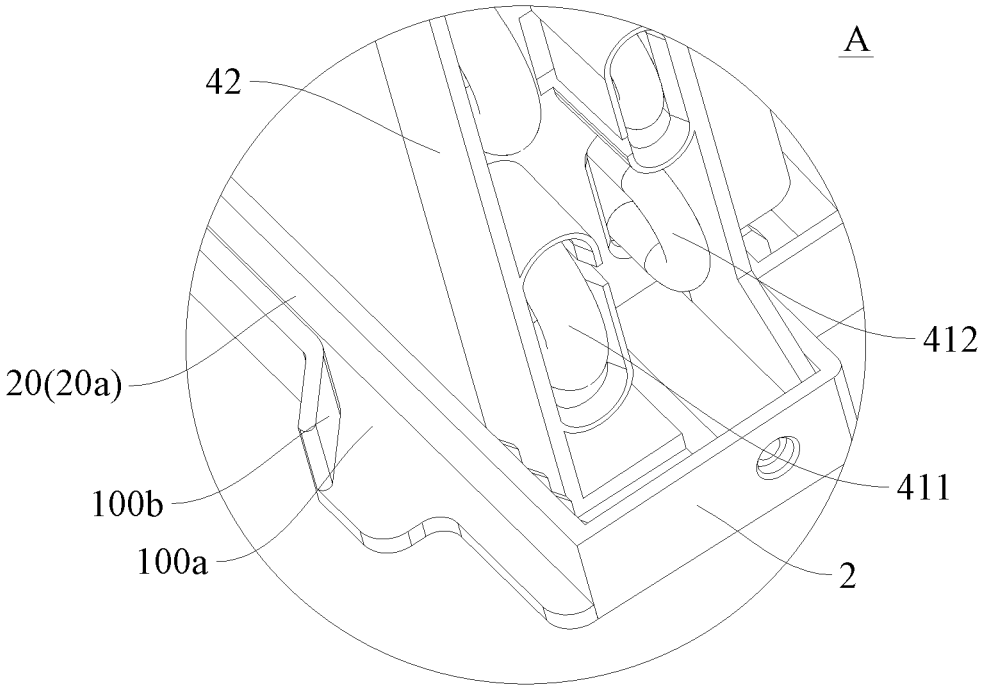
FIG. 2 is an enlarged view of portion A circled in FIG. 1.

Dehumidifier 100; lead groove 100*a*; lead wall 100*b;*
motor support 1; first guide groove 10; first groove section 10*a*; second groove section 10*b*; third groove section 10*c;*
support body 11; convex rib 111; drainage hole 112;
mounting rack 12; connection member 13; connection arm 131; pillar 14; wiring groove 141; limit clip 142;
stopper 15; first stop member 151; second stop member 152;
water pan 2; second guide groove 20; fourth groove section 20*a*; fifth groove section 20*b*; sixth groove section 20*c;*
filter screen assembly 3; filter screen skeleton 30; limit member 30*a;*
first sub-filter screen 31; second sub-filter screen 32;
heat exchanger assembly 4;
heat exchanger 41; evaporator 411; condenser 412;
side plate 42;
first heat exchanging part 43; second heat exchanging part 44; third heat exchanging part 45.

DETAILED DESCRIPTION

Reference will be made in detail to embodiments of the present application, and the examples of the embodiments are illustrated in the drawings, wherein the same or similar elements and the elements having same or similar functions are denoted by like reference numerals throughout the descriptions. The embodiments described herein with reference to drawings are illustrative, and merely used to explain the present application. The embodiments shall not be construed to limit the present application.

The following disclosure provides many different embodiments or examples for implementing different structures of the present application. In order to simplify the disclosure of the present application, the components and arrangements of the specific examples are described below. Of course, they are merely examples and are not intended to limit the present application. In addition, the present application may be repeated with reference to the numerals and/or reference numerals in the various examples. This repetition is for the purpose of simplicity and clarity, and does not indicate the relationship between the various embodiments and/or arrangements discussed. Moreover, the present application provides examples of various specific processes and materials, but one of ordinary skill in the art will recognize the applicability of other processes and/or the use of other materials.

A motor support 1 according to the embodiments of the present application will be described below with reference to accompanying drawings.

As shown in FIG. 1, the motor support 1 includes a support body 11 and a mounting rack 12 suspended below the support body 11 by a connection member 13, the connection member 13 has an upper end connected to the support body 11 and a lower end connected to the mounting rack 12, and no supporting structure for supporting the mounting rack 12 is available at a bottom of the mounting rack 12; that is, the bottom of the mounting rack 12 may be suspended in the air, such that when mounted and used, the motor support 1 is connected to other components with the support body 11, instead of being directly connected to other components with the mounting rack 12; in other words, the motor support 1 is mounted with the support body 11 instead of the mounting rack 12.

The mounting rack 12 is configured to mount a motor, such that the motor is suspended, for example, when the motor support is configured to mount the motor of a fan, the fan may be suspended, which avoids a wind shielding problem caused by the above-mentioned supporting structure, or the like, thereby reducing resistance encountered in an air flowing process, and facilitating an air flowing action; an air volume may be guaranteed by adopting a motor with lower power, providing the motor with a corresponding fan blade with a smaller diameter and operating the fan blade at a lower rotating speed, thus reducing power consumption of the motor, improving an energy efficiency ratio, and realizing energy conservation; and meanwhile, the motor runs at the lower rotating speed, which facilitates a guarantee of a sound quality of a product.

Thus, in the motor support 1 according to the embodiments of the present application, the motor may be suspended by hanging the mounting rack 12 below the support body 11 by the connection member 13; and when the motor support 1 is configured to mount the motor of the fan, positions, such as an air inlet side, or the like, of the fan are conveniently prevented from being blocked by a partial structure of the motor support 1, thereby reducing the resistance encountered in the air flowing process, reducing the power consumption while guaranteeing the air volume, facilitating achievement of the high energy efficiency, and meanwhile guaranteeing the sound quality of the product.

It may be appreciated that the connection member 13 may be configured as a structural component having certain structural strength, such that a motor position may be limited while the motor is mounted.

Figure 3:
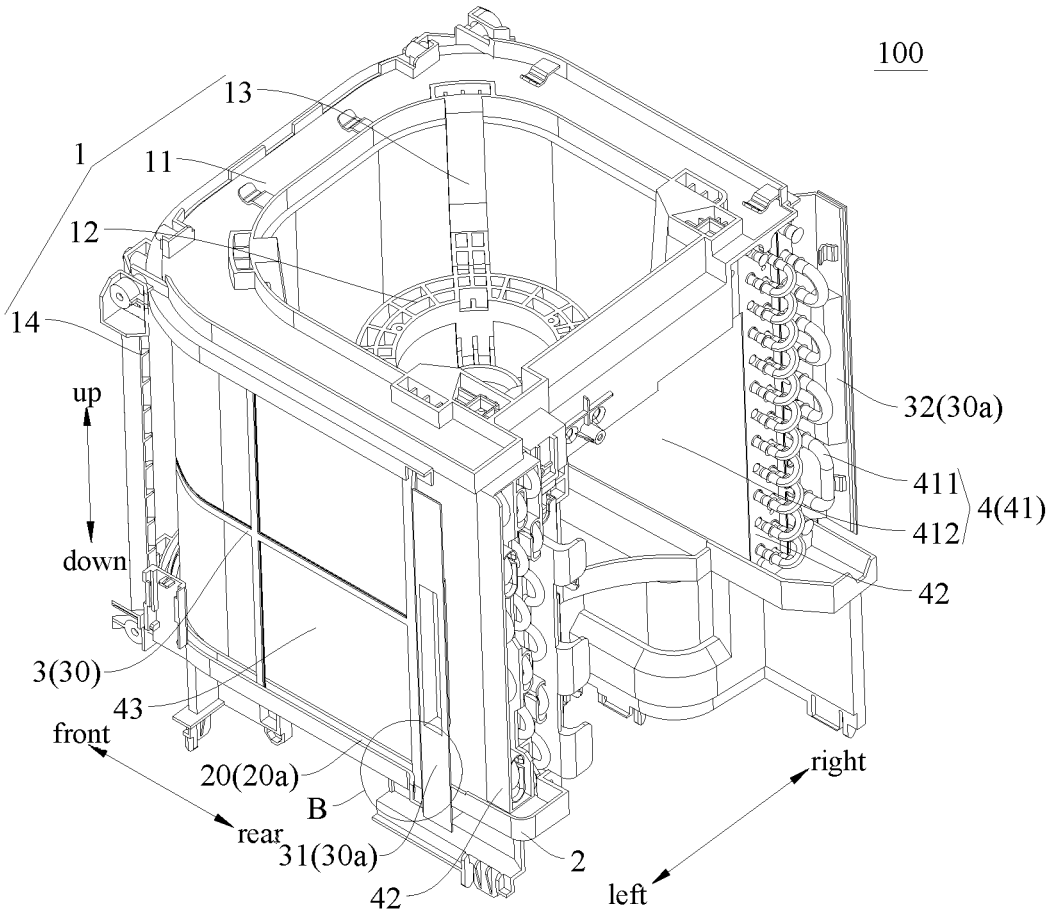
FIG. 3 is another schematic diagram of the dehumidifier shown in FIG. 1.

In examples of FIGS. 1 and 3, a central axis of the motor may extend vertically when the motor is mounted at the mounting rack 12; and the motor may drive the fan blade to rotate, and a lower side of the mounting rack 12 may be formed as an air inlet side of the fan blade.

Optionally, the central axis of the motor of the fan may extend vertically when the motor is mounted at the mounting rack 12, and the lower side of the mounting rack 12 may be formed as an air inlet side of the fan.

In some embodiments, as shown in FIG. 1, the support body 11 extends to have a closed ring or open ring shape, such that an acting force between the support body 11 and the mounting rack 12 may be distributed along a circumferential direction of the support body 11, thus facilitating a balanced stress of the support body 11 and the mounting rack 12, facilitating stable suspension of the mounting rack 12, and guaranteeing reliability of the motor suspension.

For example, the support body 11 extends to have the closed ring or open ring shape, such that the acting force between the support body 11 and the mounting rack 12 may be distributed along the circumferential direction of the support body 11, thus facilitating the balanced stress of the support body 11 and the mounting rack 12, facilitating the stable suspension of the mounting rack 12, and guaranteeing the reliability of the motor suspension; and the lower side of the mounting rack 12 may be formed as the air inlet side of the motor, and an airflow passage may be formed at the support body 11, is located downstream of the motor, and is formed as a part of an air duct in a dehumidifier 100, so as to realize airflow circulation of the dehumidifier 100.

In the example of FIG. 1, the support body 11 extends to approximately have an closed square shape, the mounting rack 12 is provided at an inner side of the support body 11, and each connection arm 13 has an upper end connected to an edge of the inner side of the support body 11, and a lower end connected to an edge of an outer side of the mounting rack 12.

It should be noted that the term "open ring shape" described herein refers to a ring shape with an opening (i.e., a non-closed ring shape), "closed ring shape" may be understood as a ring shape without opening, and "ring shape" is understood in a broad sense, that is, not limited to "circular ring shape," for example, may also be a "polygonal ring shape," or the like.

In some embodiments, as shown in FIG. 1, the support body 11 extends to have the closed ring or open ring shape, such that the support body 11 includes the airflow passage located downstream of the motor in an airflow direction. When the motor support 1 is applied to the dehumidifier 100, the airflow passage may be formed as a part of the air duct of the dehumidifier 100.

In some embodiments, as shown in FIGS. 1, 3, 5, and 6, the connection member 13 includes a plurality of connection arms 131 arranged at intervals along the circumferential direction of the support body 11, and each connection arm 131 has an upper end connected to the support body 11 and a lower end connected to the mounting rack 12, such that a structure formed by the mounting rack 12 and the connection member 13 is configured as an approximately concave structure, and the mounting rack 12 is located at a bottom of the concave structure which is suspended in the air. Thus, by providing the connection member 13 to include a plurality of connection arms 131, the connection member 13 may be prevented from excessively obstructing the airflow on the premise of guaranteeing the reliable arrangement of the mounting rack 12.

It should be noted that in the description of the present application, "a plurality of" means two or more.

For example, in the example of FIG. 1, the support body 11 extends to approximately have an open square or closed square shape, the mounting rack 12 is provided at the inner side of the support body 11, and each connection arm 131 has the upper end connected to the edge of the inner side of the support body 11, and the lower end connected to the edge of the outer side of the mounting rack 12.

Optionally, the connection arm 131 may be configured as a sheet metal part.

Figure 5:
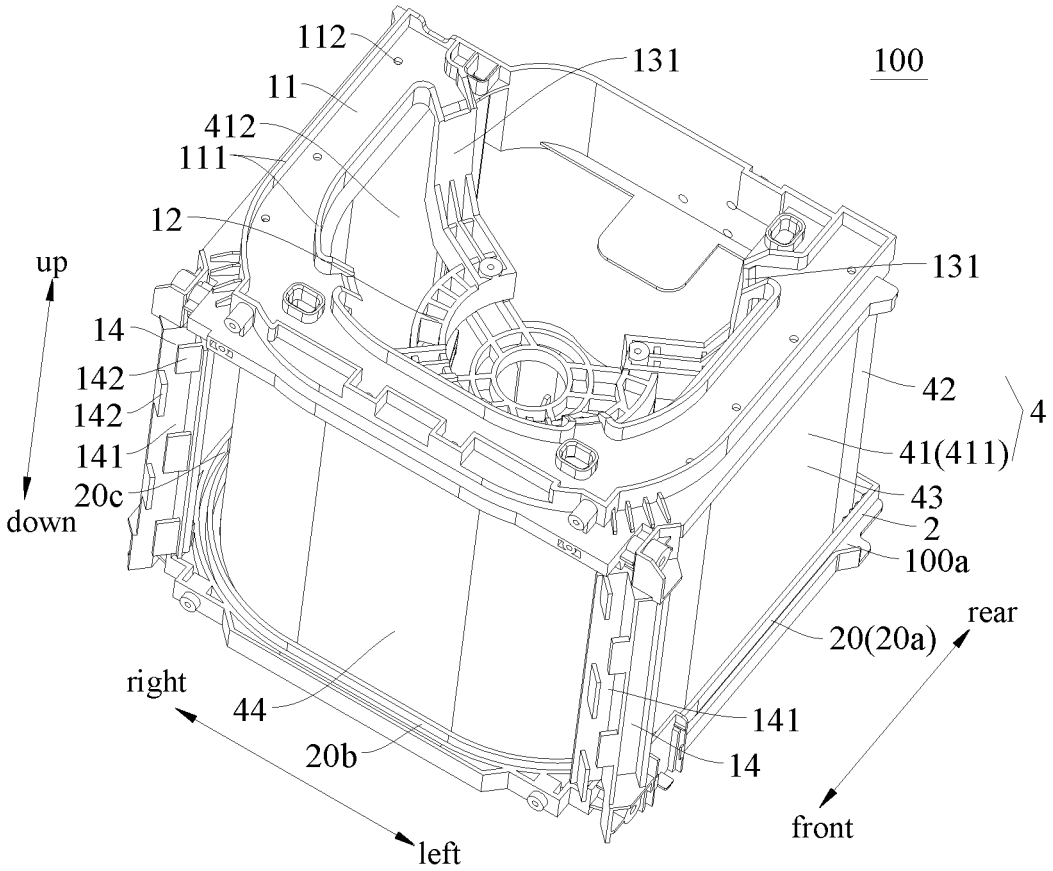
FIG. 5 is yet another schematic diagram of the dehumidifier shown in FIG. 1.

In some embodiments, as shown in FIGS. 1, 3, and 5, the motor support 1 further includes a pillar 14 for supporting a bottom of the support body 11, such that the pillar 14 may support the support body 11, thereby enhancing stability of the support body 11 and reducing shaking of the support body 11 during operation of the motor. For example, when the motor support 1 is applied to the dehumidifier 100, the pillar 14 may be provided between the support body 11 and other components (for example, a water pan 2 described later) of the dehumidifier 100 for support, so as to guarantee stability of the motor support 1.

For example, in the examples of FIGS. 1, 3 and 5, the support body 11 extends to have the closed ring or open ring shape, there are a plurality of pillars 14, and the plurality of pillars 14 are arranged at intervals along the circumferential direction of the support body 11, so as to stably support the support body 11 by the pillars. Certainly, the number of the pillar 14 may be one to be flexibly matched with actual applications.

In some embodiments, as shown in FIG. 5, a wiring groove 141 is formed at the pillar 14, and wiring of the motor at the mounting rack 12 may be performed through the wiring groove 141.

For example, the wiring groove 141 may have an open side, and a limit clip 142 may be provided at an edge of the open side of the wiring groove 141, and has one end connected to the pillar 14, and the other end formed as a free end; and there are a plurality of limit clips 142, the plurality of limit clips 142 are arranged at intervals in an extension direction of the wiring groove 141, and two adjacent limit clips 142 are located at edges of two opposite sides of the open side respectively, so as to limit wiring on the premise of realizing smooth wiring to guarantee the regular wiring.

Figure 6:
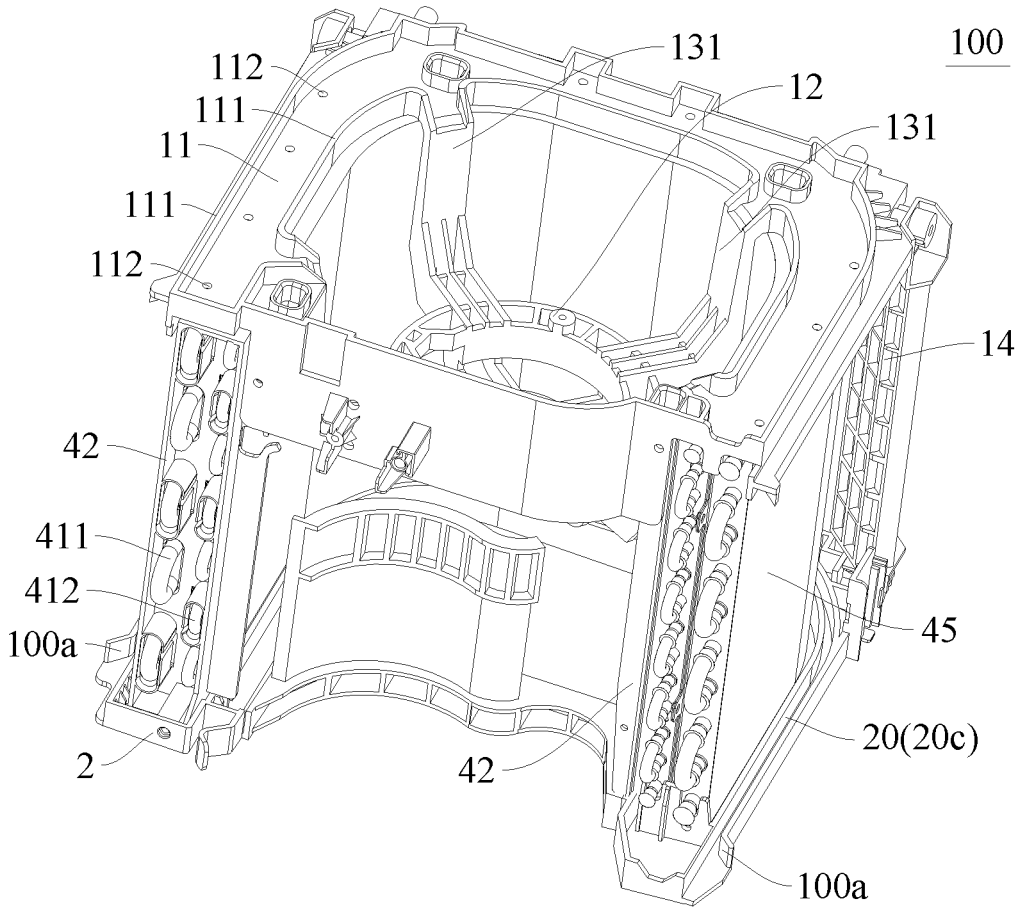
FIG. 6 is still another schematic diagram of the dehumidifier shown in FIG. 1.
Figure 7:
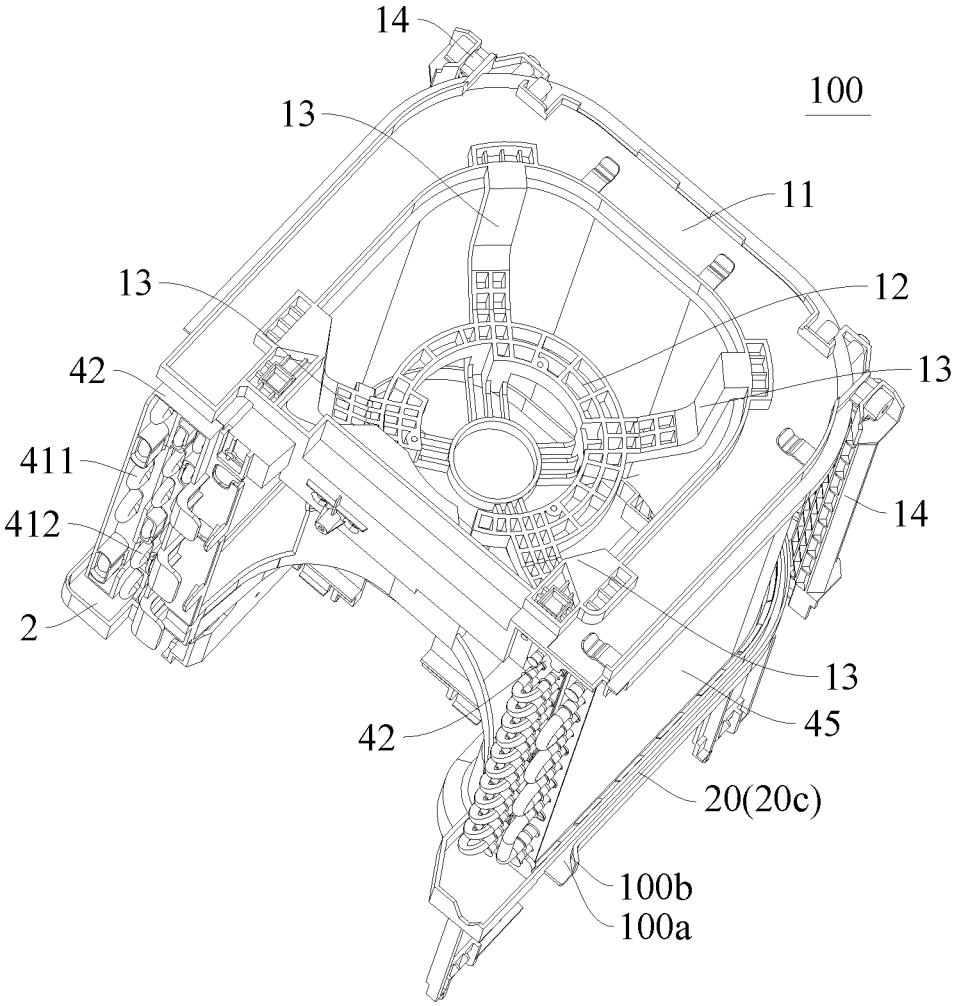
FIG. 7 is still another schematic diagram of the dehumidifier shown in FIG. 1.

For example, as shown in FIGS. 1 and 6, the motor support 1 is used in the dehumidifier 100, and the mounting rack 12 is configured to mount the motor of the fan of the dehumidifier 100. It may be understood that the motor support 1 may also be used in other electric appliances having motors, which are not limited to the dehumidifier 100.

In some embodiments, as shown in FIGS. 1, 3, 5, and 6, an evaporator 411 of the dehumidifier 100 is configured to be supported at a lower side of the support body 11, which is favorable to enhancing the supporting stability of the support body 11, and the support body 11 is closer to the evaporator 411, such that a temperature of the support body 11 is relatively low due to a relatively low temperature of the evaporator 411. An upper surface of the support body 11 is provided with at least one of a convex rib 111 or a drainage hole 112, which includes the following three modes: 1, the upper surface of the support body 11 is provided with the convex rib 111; 2, the upper surface of the support body 11 is provided with the drainage hole 112; and 3, the upper surface of the support body 11 is provided with the convex rib 111 and the drainage hole 112.

When the upper surface of the support body 11 is provided with the convex rib 111, the convex rib 111 is configured to abut against a housing of the dehumidifier 100, so as to separate the upper surface of the support body 11 from the housing of the dehumidifier 100, and avoid condensation caused by contact between the housing and the upper surface of the support body 11, thereby reducing a probability of condensation of the housing, and facilitating maintenance of the dehumidifier 100; when the upper surface of the support body 11 is provided with the drainage hole 112, the drainage hole 112 runs through the support body 11 in an up-down direction, and if generated on the upper surface of the support body 11 due to factors, such as the evaporator 411, or the like, the condensation may be drained downwards through the drainage hole 112, for example, flow onto the evaporator 411 through the drainage hole 112 to be collected and drained together with condensed water generated by the evaporator 411, thus avoiding bacteria breeding caused by long-term stay of the condensed water.

It may be understood that there may be one or more drainage holes 112, and when there are a plurality of drainage holes 112, positions and arrangements of the plurality of drainage holes 112 may be specifically set according to actual requirements.

Figure 9:
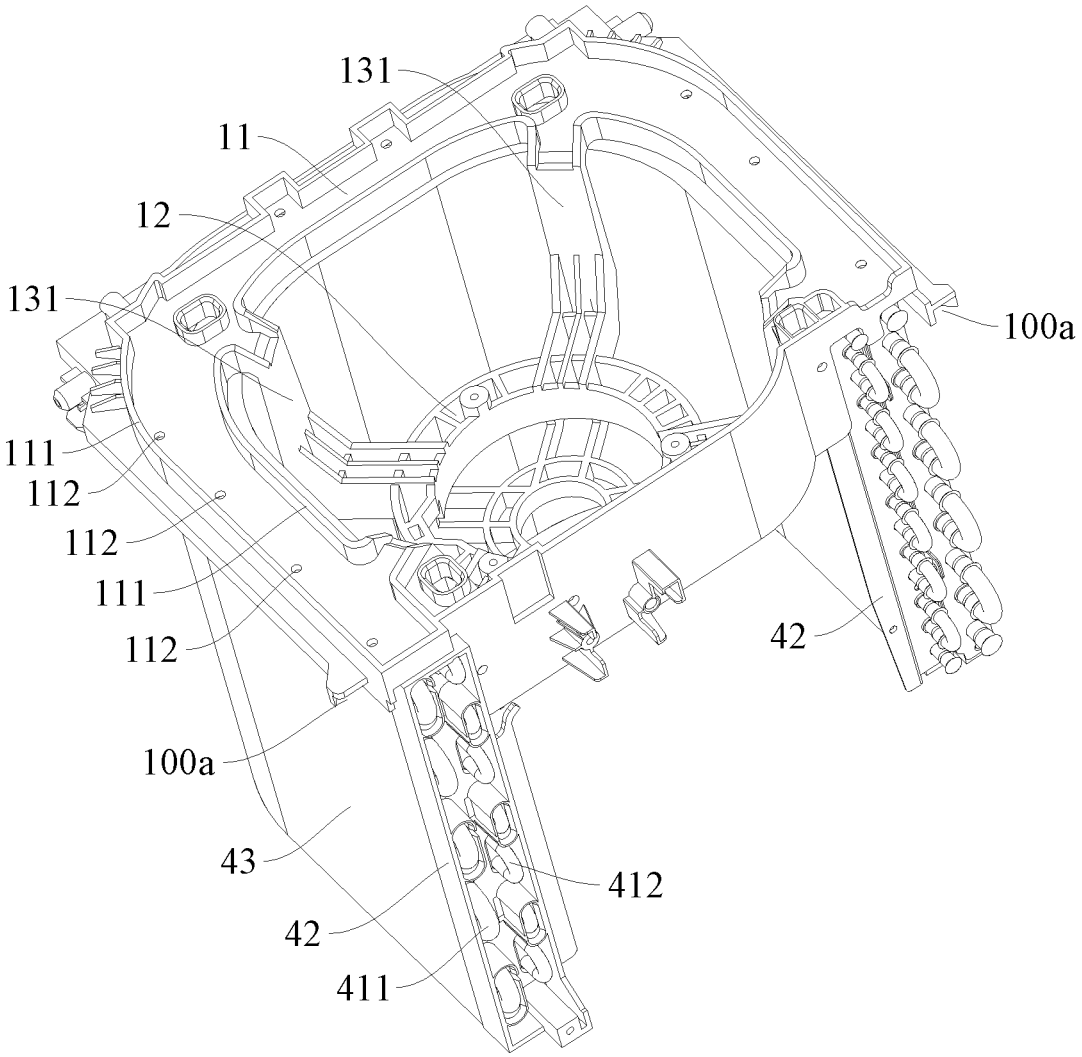
FIG. 9 is another schematic assembly diagram of the motor support and the heat exchanger shown in FIG. 8.

In the examples of FIGS. 5, 6, and 9, the support body 11 is formed into the closed ring shape, and the convex ribs 111 are provided at the edges of the inner and outer sides of the support body 11, and the convex ribs 111 extend to have closed ring or open ring shapes.

Figure 16:
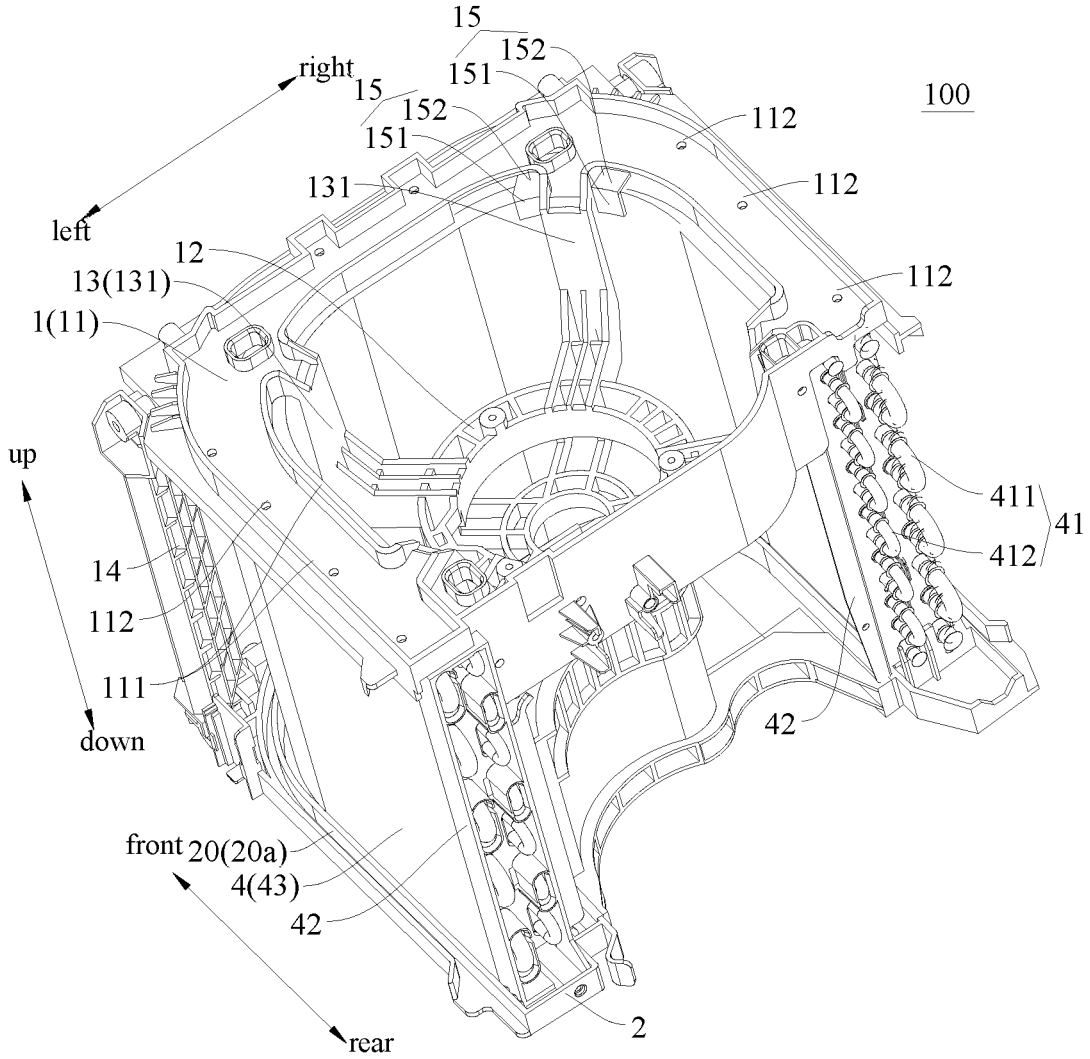
FIG. 16 is a schematic diagram of a dehumidifier according to another embodiment of the present application.

In some embodiments, as shown in FIG. 16, a condenser 412 of the dehumidifier 100 is configured to be supported at the lower side of the support body 11, which is beneficial to enhancing the supporting stability of the support body 11; and a stopper 15 is formed at the support body 11, and configured to abut against the condenser 412, so as to realize limitation and fixation of the support body 11 and the condenser 412, and improve an assembly efficiency of the dehumidifier 100.

In some embodiments, as shown in FIG. 16, the evaporator 411 and the condenser 412 of the dehumidifier 100 are configured to be supported at the lower side of the support body 11, and shapes of the evaporator 411 and the condenser 412 may be matched with a shape of the support body 11, so as to effectively guarantee the stability of the support body 11; the upper surface of the support body 11 is provided with the convex rib 111 and/or the drainage hole 112, the convex rib 111 is configured to abut against the housing of the dehumidifier 100, the drainage hole 112 runs through the support body 11 in the up-down direction, and the stopper 15 is further formed at the support body 11, and configured to abut against the condenser 412, so as to guarantee assemblability of the support body 11, the evaporator 411 and the condenser 412.

In some embodiments, as shown in FIG. 16, when formed at the support body 11, the stopper 15 includes a first stop member 151 and/or a second stop member 152, that is, the sopper 15 includes at least one of the first stop member 151 or the second stop member 152, the first stop member 151 is configured to abut against one side of the condenser 412 in a width direction (e.g., the radial direction of the condenser in FIG. 16) to limit relative positions of the support body 11 and the condenser 412 in the width direction of the condenser 412, and the second stop member 152 is configured to abut against one side of the condenser 412 in a height direction (e.g., the up-down direction in FIG. 16), for example, a top of the condenser 412, so as to limit relative positions of the support body 11 and the condenser 412 in the height direction of the condenser 412.

For example, in the example of FIG. 16, the condenser 412 extends to have an open-ring-shaped structure, the stopper 15 includes the first and second stop members 151, 152, the first stop member 151 is configured to abut against a radial inner side of the condenser 412, the second stop member 152 is configured to abut against the top of the condenser 412, and then, the stopper 15 may be formed into an approximately L-shaped structure; and the stopper 15 is located at an edge of the support body 11, such that the stopper 15 may conveniently abut against a corner of the condenser 412, and the arrangement of the stopper 15 is facilitated. It may be understood that the position of the stopper 15 at the support body 11 is not limited thereto.

In some embodiments, as shown in FIG. 16, when the stopper 15 is formed at the support body 11, there are a plurality of stoppers 15, and the plurality of stoppers 15 are arranged at intervals in a length direction of the condenser 412 (for example, the circumferential direction of the condenser 412 in FIG. 16), so as to guarantee limitation between the entire support body 11 and the entire condenser 412, which is beneficial to improving the assembly efficiency of the support body 11 and the condenser 412.

In some embodiments, as shown in FIG. 16, the connection member 13 includes a plurality of connection arms 131 arranged at intervals in the extension direction of the support body 11, the end of each connection arm 131 connected to the support body 11 has two sides in the length direction of the condenser 412 provided with the stoppers 15 respectively, and the stoppers 15 are connected to the support body 11 and the corresponding connection arms 131 respectively, which is beneficial to improving a bearing capacity of the stoppers 15, and guarantees reliable use of the stoppers 15.

Optionally, the connection arm 131, the support body 11, and the stopper 15 may be configured as an integrally formed part.

It may be understood that the support body 11 may not be provided with the stopper 15, and at this point, the support body may abut against the condenser 412 by a structure formed by bending and extending the connection member 13, so as to limit the support body 11 and the condenser 412; but the present application is not limited thereto.

A dehumidifier 100 according to the embodiments of a second aspect of the present application will be described below with reference to accompanying drawings.

As shown in FIG. 1, the dehumidifier 100 includes a housing, a water pan 2 and a motor support 1, an air inlet is formed at the housing, and when the dehumidifier 100 operates, external air may flow into the housing through the air inlet for dehumidification, so as to improve the environment; and the water pan 2 is provided in the housing, and the motor support 1 is provided in the housing. The motor support 1 is configured as the motor support 1 according to the embodiments of the first aspect of the present application, the support body 11 is provided above the water pan 2, the mounting rack 12 is located between the support body 11 and the water pan 2 in the up-down direction, a motor of a fan of the dehumidifier 100 is mounted at the mounting rack 12, and the water pan 2 may be configured to collect moisture in air removed by the dehumidifier 100.

In the dehumidifier 100 according to the embodiments of the present application, the adoption of the above-mentioned motor support 1 is favorable to guaranteeing an air volume of the dehumidifier 100, reducing power consumption, and achieving a high energy efficiency.

In some embodiments, as shown in FIGS. 1, 3 and 6, the housing is further provided therein with a heat exchanger assembly 4 located at the water pan 2 between the water pan 2 and the support body 11, the heat exchanger assembly 4 may process the air to remove water vapor in the air, for example, condense the water vapor in the air into water drops, and the condensed water may be collected into the water pan 2, so as to drain the condensed water. The heat exchanger assembly 4 includes a heat exchanger 41 and two side plates 42 arranged at two ends of the heat exchanger 41 respectively, and the two side plates 42 are fixedly connected to the water pan 2 respectively, so as to fix the heat exchanger assembly 4; the support body 11 is supported at a top of the heat exchanger 41, such that the heat exchanger 41 may support the support body 11 to a certain extent, so as to guarantee the stability of the support body 11; and the support body 11 is fixedly connected to the two side plates 42 respectively, thus fixing the support body 11; and meanwhile, the side plates 42 may support the support body 11 to a certain extent, thus improving stability of the mounting rack 12. Thus, the side plate 42 may realize a fixed connection of the support body 11 and the water pan 2 and a fixed connection of the heat exchanger 41 and the water pan 2, thus guaranteeing assembly firmness among the support body 11, the water pan 2 and the heat exchanger assembly 4.

The heat exchanger 41 includes an evaporator 411 and a condenser 412 sequentially arranged from inside to outside, and in an airflow direction, the condenser 412 is located downstream of the evaporator 411, such that airflow passes through the evaporator 411 to condense the water vapor in the air into the water drops, so as to remove the water vapor in the air, and then, the airflow passes through the condenser 412 to heat and dry the air with the water vapor removed, such that outlet air of the dehumidifier 100 returns to a normal temperature. It should be noted that the direction "inside" refers to a direction close to a central axis of the housing, an opposite direction is defined as "outside," and the central axis of the housing extends vertically.

In some embodiments, as shown in FIGS. 1, 5 and 6, the heat exchanger assembly 4 includes a first heat exchanging part 43, a second heat exchanging part 44 and a third heat exchanging part 45 arranged along a circumferential direction of the housing, the first heat exchanging part 43 is arranged opposite to the third heat exchanging part 45, and the second heat exchanging part 44 is connected between the first and third heat exchanging parts 43, 45, such that the heat exchanger assembly 4 extends to have an approximately U shape, which is beneficial to increasing a contact area between the air and the heat exchanger assembly 4 and improving an air treatment efficiency. One of the two side plates 42 is provided at the end of the first heat exchanging part 43 away from the second heat exchanging part 44, and the other side plate 42 is provided at the end of the third heat exchanging part 45 away from the second heat exchanging part 44.

The motor support 1 further includes a pillar 14 provided between the support body 11 and the water pan 2 for support, thus enhancing the stability of the support body 11 and reducing shaking thereof; and the pillar 14 and the two side plates 42 may be arranged at intervals in the extension direction of the support body 11 to stably support the support body 11.

As shown in FIGS. 1, 5, and 6, the pillar 14 and the side plate 42 are located at two opposite ends of the support body 11 respectively, so as to guarantee stable support of the support body 11 by the pillar 14 and the side plate 42; for example, in the examples of FIGS. 1, 5, and 6, the support body 11 extends to have the closed ring or open ring shape, there are a plurality of pillars 14, the plurality of pillars 14 and the two side plates 42 are provided at intervals along the circumferential direction of the support body 11, and the side plates 42 and the pillars 14 may be arranged at corners of the support body 11 for support; the heat exchanger 41 extends to have the approximately U shape, the two side plates 42 are arranged at two ends of the heat exchanger 41 in the extension direction respectively, the support body 11 extends to have an approximately square shape, the two side plates 42 are correspondingly arranged at two adjacent corners of one end of the square structure formed by the support body 11 respectively, and each of rest two corners of the other end of the square structure formed by the support body 11 is provided with one pillar 14, such that the two side plates 42 and the two pillars 14 both support the support body 11, which guarantees the stability of the support body 11.

Figure 11:
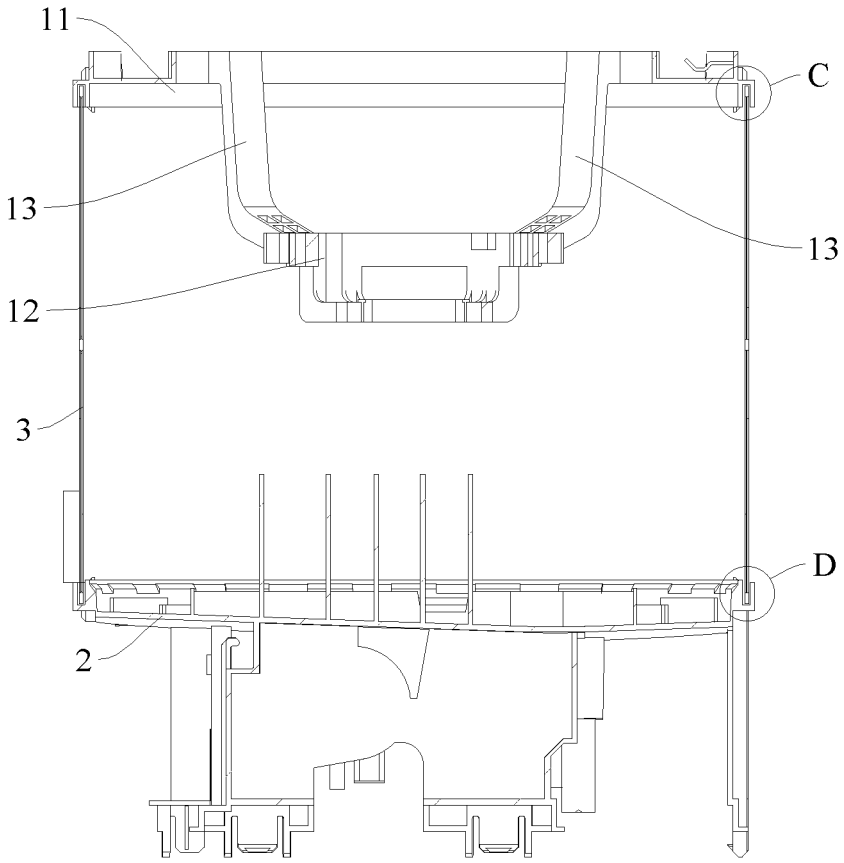
FIG. 11 is a sectional view of a partial mechanism of the dehumidifier shown in FIG. 1.
Figure 14:
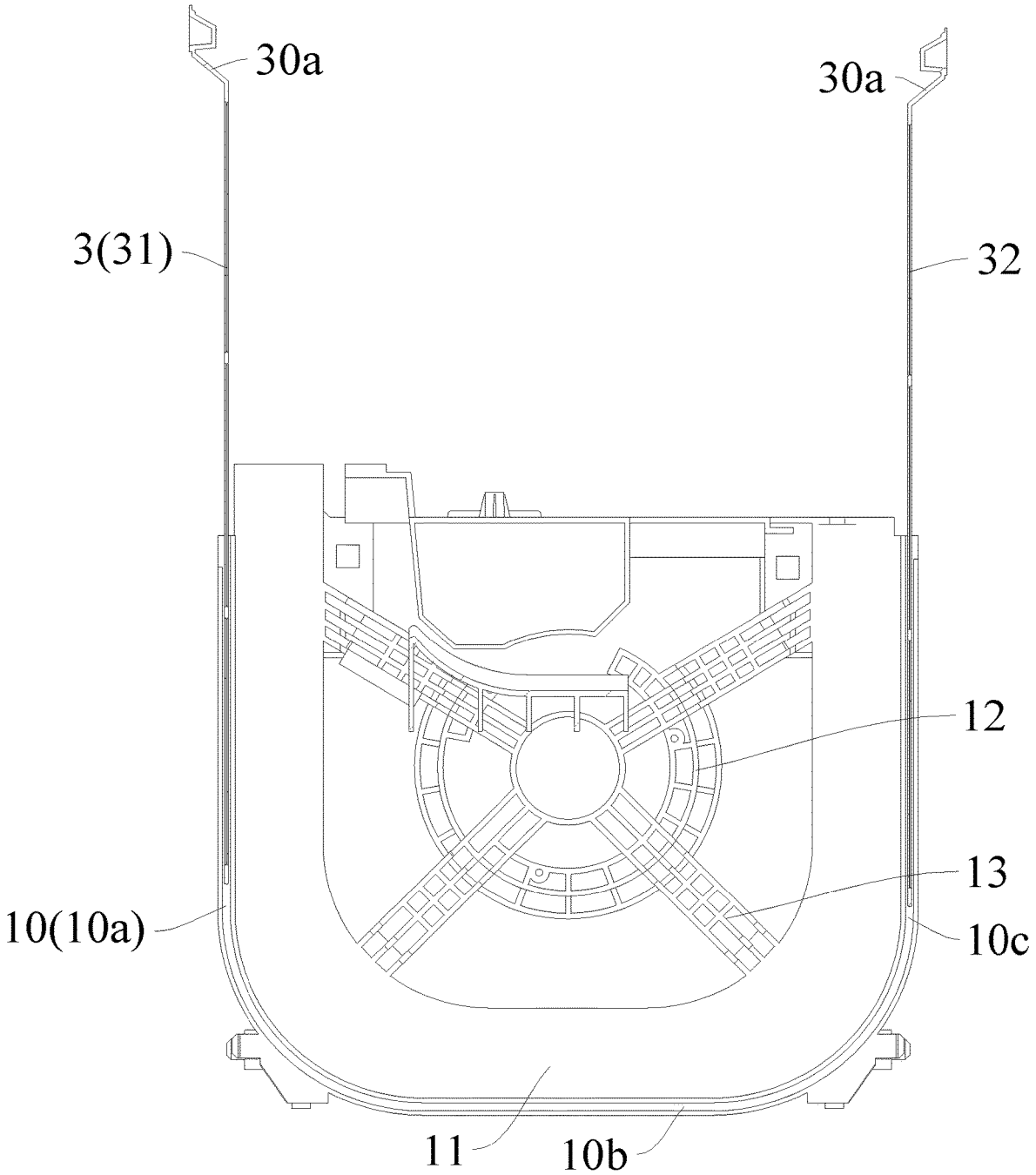
FIG. 14 is a schematic mounting diagram of a filter screen assembly shown in FIG. 3.
Figure 15:
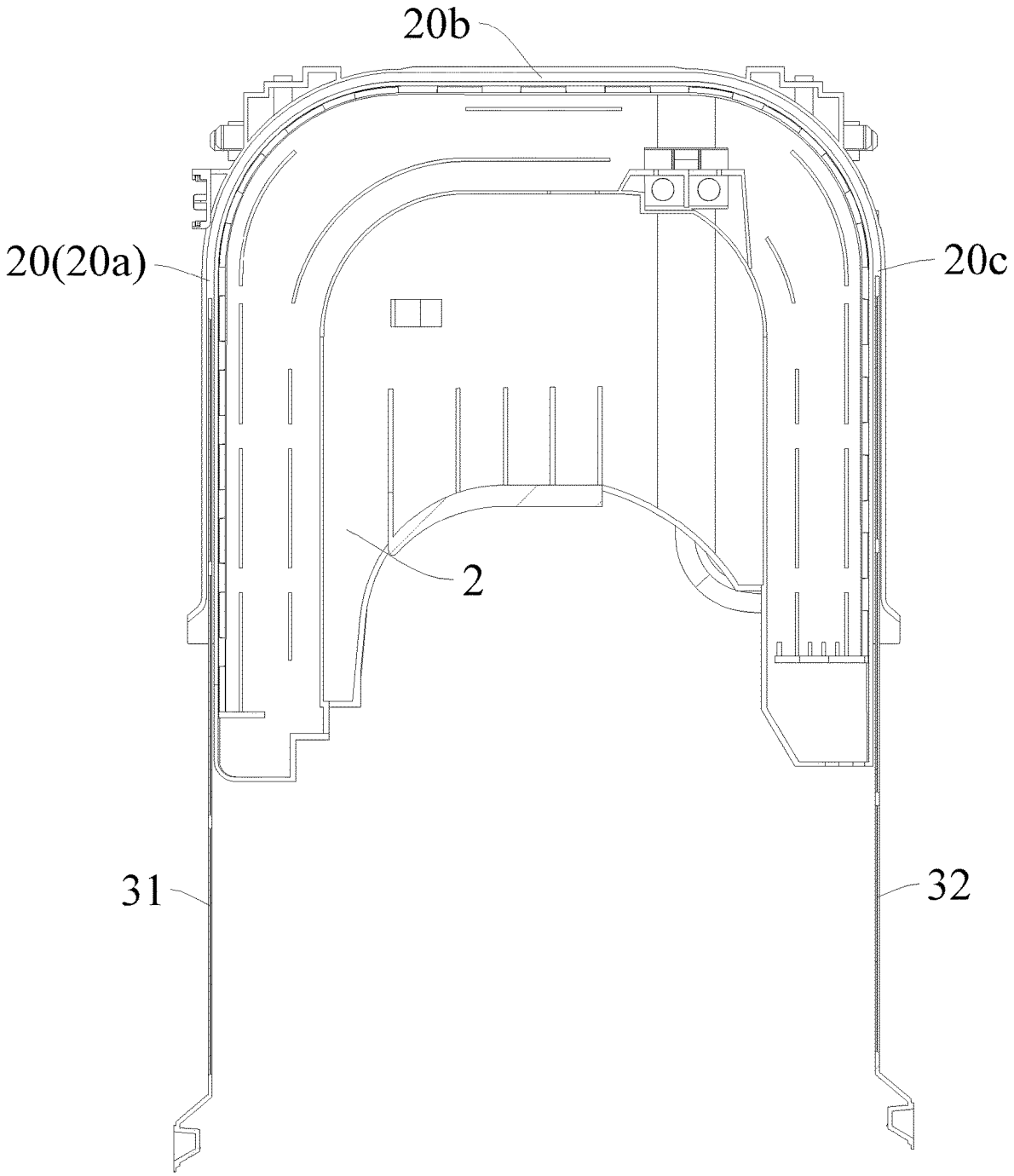
FIG. 15 is another schematic mounting diagram of the filter screen assembly shown in FIG. 3.

In some embodiments, as shown in FIGS. 11, 14, and 15, the dehumidifier 100 further includes a filter screen assembly 3 covering the air inlet to filter the air flowing into the housing through the air inlet; a first guide groove 10 is formed at the motor support 1, a second guide groove 20 is formed at the water pan 2, and an upper end and a lower end of the filter screen assembly 3 pass through one length end of the first guide groove 10 and one length end of the second guide groove 20 respectively, and are drawably inserted into the first and second guide grooves 10, 20 respectively, for example, the first guide groove 10 is provided above the second guide groove 20 and spaced apart therefrom, the upper end of the filter screen assembly 3 is drawably inserted into the first guide groove 10, and the lower end of the filter screen assembly 3 is drawably inserted into the second guide groove 20, such that the filter screen assembly 3 may be drawn and moved in a direction perpendicular to the up-down direction relative to the first and second guide grooves 10, 20.

Thus, when required to be cleaned or replaced, the filter screen assembly 3 may be drawn out from the first and second guide grooves 10, 20, thus quickly disassembling the filter screen assembly 3 and facilitating maintenance thereof; and when the filter screen assembly 3 is mounted, the upper and lower ends of the filter screen assembly 3 are inserted into the first and second guide grooves 10, 20 through one length end of the first guide groove 10 and one length end of the second guide groove 20 respectively, and a casing of the filter screen assembly 3 is moved to quickly mount the filter screen assembly 3, thus improving use convenience of the dehumidifier 100.

Moreover, since the first guide groove 10 is formed at the motor support 1 and the second guide groove 20 is formed at the water pan 2, on the premise of ensuring that the filter screen assembly 3 covers the air inlet, a distance between the above-mentioned two ends of the filter screen assembly 3 may be properly reduced, thereby reducing an area of the filter screen assembly 3, saving material consumption of the filter screen assembly 3 and reducing a cost; and at this point, the motor support 1 may have multiple functions, and may be configured to mount the motor of the fan of the dehumidifier 100 or the filter screen assembly 3, multiple purposes are achieved, and a structural design of the product is convenient to rationalize.

It may be understood that "one length end of the first guide groove 10" in "the upper end of the filter screen assembly 3 is drawably inserted into the first guide groove 10 through one length end of the first guide groove 10" may refer to any of two length ends of the first guide groove 10, and similarly, "one length end of the second guide groove 20" in "the lower end of the filter screen assembly 3 is drawably inserted into the second guide groove 20 through one length end of the second guide groove 20" may refer to any of two length ends of the second guide groove 20. Certainly, when the filter screen assembly 3 includes a plurality of sub-filter screens, the sub-filter screens may be mounted through the same end or different ends of the first guide groove 10 (or the second guide groove 20) in a length direction.

In some embodiments, as shown in FIGS. 14 and 15, the first guide groove 10 is formed at the support body 11, so as to ensure that the filter screen assembly 3 does not interfere with the motor on the mounting rack 12, guarantee mounting reliability of the filter screen assembly 3, achieve a smooth mounting goal of the filter screen assembly 3 and the motor, facilitate assembly of components in the housing into a whole, and guarantee structural stability of the dehumidifier 100. For example, the first guide groove 10 is located at the edge of the support body 11, the second guide groove 20 is located at an edge of the water pan 2, the first guide groove 10 is provided above the second guide groove 20 and spaced apart therefrom, the upper end of the filter screen assembly 3 is drawably inserted into the first guide groove 10 through one length end of the first guide groove 10, and the lower end of the filter screen assembly 3 is drawably inserted into the second guide groove 20 through one length end of the second guide groove 20.

Figure 10:
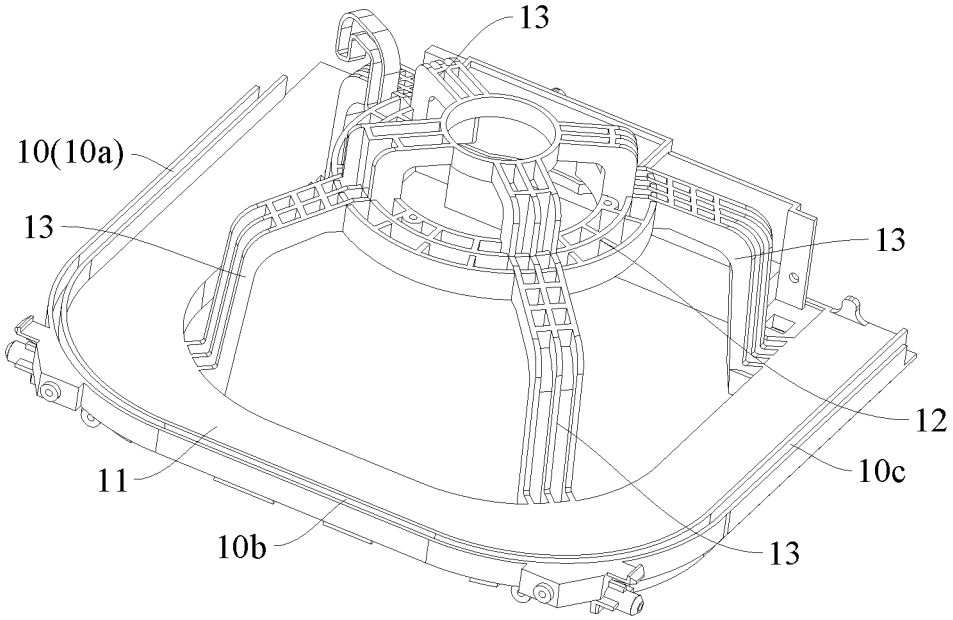
FIG. 10 is a schematic diagram of the motor support shown in FIG. 9.

For example, in the example of FIG. 10, the first guide groove 10 is formed at the edge of the support body 11, and the support body 11 may be provided with two first guide ribs spaced apart from each other to form the first guide groove 10 therebetween. The second guide groove 20 may be formed at the edge of the water pan 2, and the water pan 2 is provided with two second guide ribs spaced apart from each other to form the second guide groove 20 therebetween.

Figure 4:
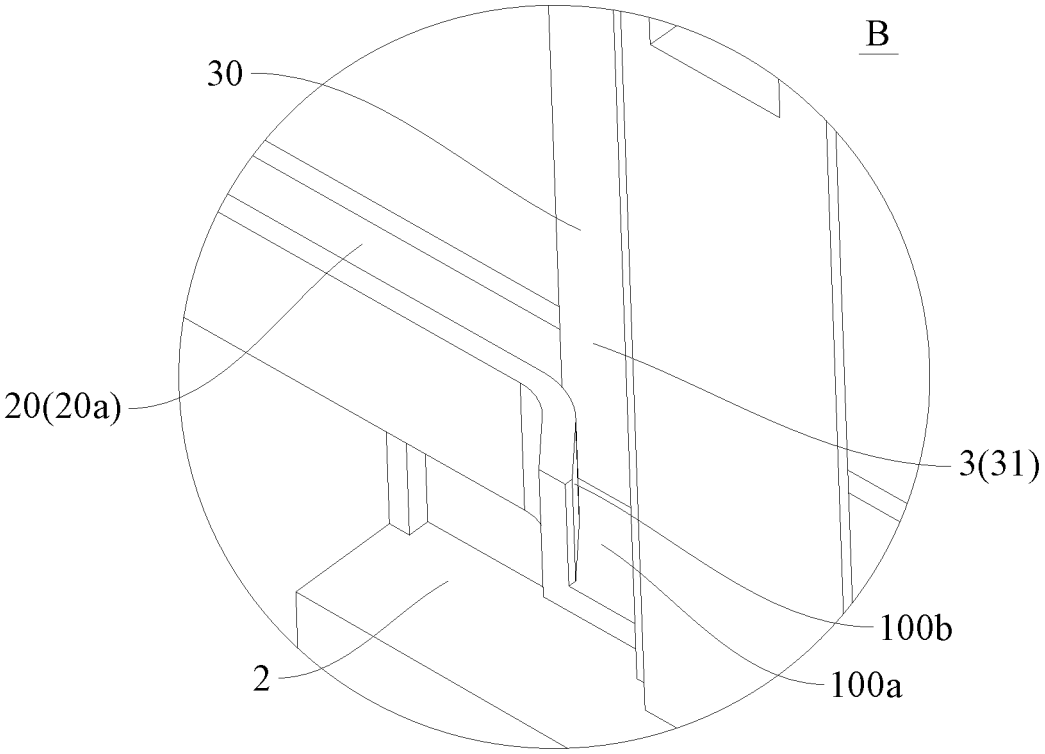
FIG. 4 is an enlarged view of portion B circled in FIG. 3.

In some embodiments, as shown in FIGS. 4, 6 and 9, at least one length end of at least one of the first guide groove 10 or the second guide groove 20 is provided with a lead groove 100*a*, which may include the following cases: 1, at least one length end of the first guide groove 10 is provided with a lead groove 100*a*, and the second guide groove 20 is not provided with the lead groove 100*a;* 2, at least one length end of the second guide groove 20 is provided with a lead groove 100*a*, and the first guide groove 10 is not provided with the lead groove 100*a*; and 3, at least one length end of the first guide groove 10 is provided with a lead groove 100*a*, and at least one length end of the second guide groove 20 is provided with a lead groove 100*a*.

A width of the lead groove 100*a* is gradually reduced towards a center of the filter screen assembly 3, such that the filter screen assembly 3 may pass through the lead groove 100*a* to be inserted into the first and second guide grooves 10, 20, and the lead groove 100*a* may play a role of guiding the filter screen assembly 3, such that the filter screen assembly 3 may be smoothly inserted into the first and second guide grooves 10, 20, thus improving a mounting efficiency of the filter screen assembly 3.

For example, in the example of FIG. 4, the two length ends of the first guide groove 10 are provided with the lead grooves 100*a* respectively, each lead groove 100*a* has a lead wall 100*b*, and smooth transition is performed between the lead wall 100*b* and a wall surface of the first guide groove 10, which is beneficial to improving drawing smoothness of the filter screen assembly 3. Certainly, non-smooth transition may be performed between the lead wall 100*b* and the wall surface of the first guide groove 10.

Figure 12:
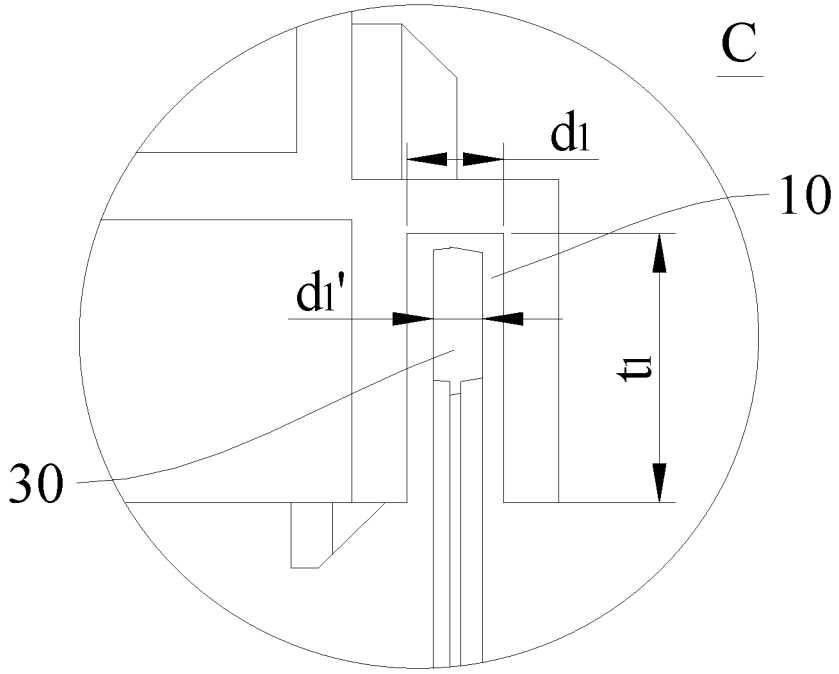
FIG. 12 is an enlarged view of portion C circled in FIG. 11.
Figure 13:
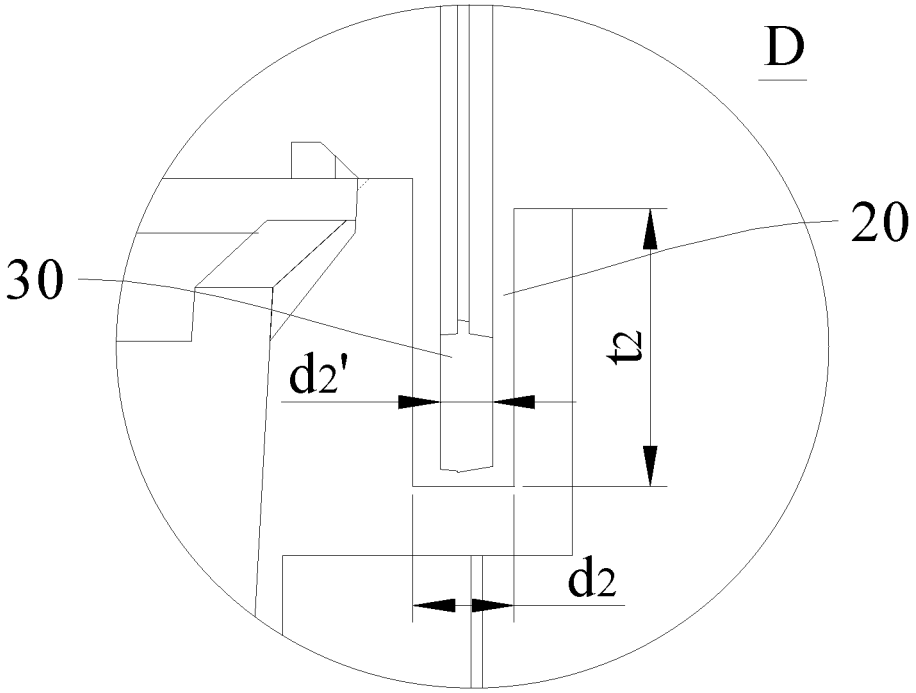
FIG. 13 is an enlarged view of portion D circled in FIG. 11.

In some embodiments, as shown in FIGS. 12 and 13, the first guide groove 10 has a depth $t_1$, the second guide groove 20 has a depth $t_2$, $t_1>5$ mm, and $t_2>5$ mm, so as to ensure that the filter screen assembly 3 is inserted into the first and second guide grooves 10, 20 by a sufficient depth, thereby guaranteeing a reliable fit between the filter screen assembly 3 and the first guide groove 10 and between the filter screen assembly 3 and the second guide groove 20, realizing a reliable mounting goal of the filter screen assembly 3, and preventing the filter screen assembly 3 from being easily separated from the first or second guide groove 10, 20.

In some embodiments, as shown in FIGS. 12 and 13, the filter screen assembly 3 includes a filter screen and a filter screen skeleton 30, and the filter screen is provided at the filter screen skeleton 30, and covers the air inlet to achieve an air filtering effect; the filter screen skeleton 30 may be drawably inserted into the first and second guide grooves 10, 20, the first guide groove 10 has a width $d_1$, the second guide groove 20 has a width $d_2$, the part of the filter screen skeleton 30 inserted into the first guide groove 10 has a width $d_1'$, the part of the filter screen skeleton 30 inserted into the second guide groove 20 has a width $d_2'$, 1 mm$\leq d_1-d_1'\leq$2 mm, and 1 mm$\leq d_2-d_2'\leq$2 mm; that is, the width of the first guide groove 10 is 1 mm to 2 mm wider than the width of the part of the filter screen skeleton 30 fitted into the first guide groove 10, and the width of the second guide groove 20 is 1 mm to 2 mm wider than the width of the part of the filter screen skeleton 30 fitted into the second guide groove 20, thereby ensuring that on the premise that the filter screen assembly 3 is effectively limited by the first and second guide grooves 10, 20, the filter screen assembly 3 is conveniently drawn and moved relative to the first and second guide grooves 10, 20, and then further facilitating rapid disassembly and assembly of the filter screen assembly 3.

In some embodiments, there are three air inlets, and the three air inlets are arranged along the circumferential direction of the housing, so as to realize "three-side air supply" of the dehumidifier 100. For example, the housing includes a first side wall, a second side wall and a third side wall arranged along the circumferential direction of the housing, the first side wall is provided opposite to the third side wall, the second side wall is connected between the first and third side walls, the air inlets include a first air inlet, a second air inlet, and a third air inlet, the first air inlet is formed at the first side wall, the second air inlet is formed at the second side wall, and the third air inlet is formed at the third side wall. Thus, when the dehumidifier 100 operates, the air may flow into the housing in three directions respectively to form "three-side air supply," such that an air inlet area of the dehumidifier 100 is increased, thereby increasing an air treatment area of the dehumidifier 100, and facilitating an improvement of the air treatment efficiency; moreover, under the same air volume, an air inlet speed of the dehumidifier 100 may be reduced, thereby reducing airflow loss and facilitating high-efficiency operation of the dehumidifier 100.

For example, the first and third air inlets are formed at left and right sides of the housing respectively, and the second air inlet is formed at a front side of the dehumidifier 100.

It should be noted that an axial direction of the housing may be understood as a vertical direction, such that the central axis of the housing extends vertically, and the circumferential direction of the housing may be understood as a direction around the central axis of the housing.

As shown in FIGS. 1, 5 and 6, the housing is further provided therein with the heat exchanger assembly 4 located downstream of the filter screen assembly 3 in the airflow direction, and the heat exchanger assembly 4 extends along the circumferential direction of the housing, and is provided opposite to the three air inlets, such that the airflow flowing into the housing from the three air inlets flows to the heat exchanger assembly 4 and may flow to different positions of the heat exchanger assembly 4. For example, the heat exchanger assembly 4 includes the first, second and third heat exchanging parts 43, 44, 45 arranged along the circumferential direction of the housing, the first heat exchanging part 43 is arranged corresponding to the first air inlet, the second heat exchanging part 44 is arranged corresponding to the second air inlet, and the third heat exchanging part 45 is arranged corresponding to the third air inlet, such that the first heat exchanging part 43 is adjacent to the first air inlet and is arranged opposite to the first air inlet, the second heat exchanging part 44 is adjacent to the second air inlet and is arranged opposite to the second air inlet, the third heat exchanging part 45 is adjacent to the third air inlet and is arranged opposite to the third air inlet, and thus, the heat exchanger assembly 4 extends to have the approximately U shape to be matched with the air inlets at the housing, thereby guaranteeing the air treatment efficiency.

Figure 8:
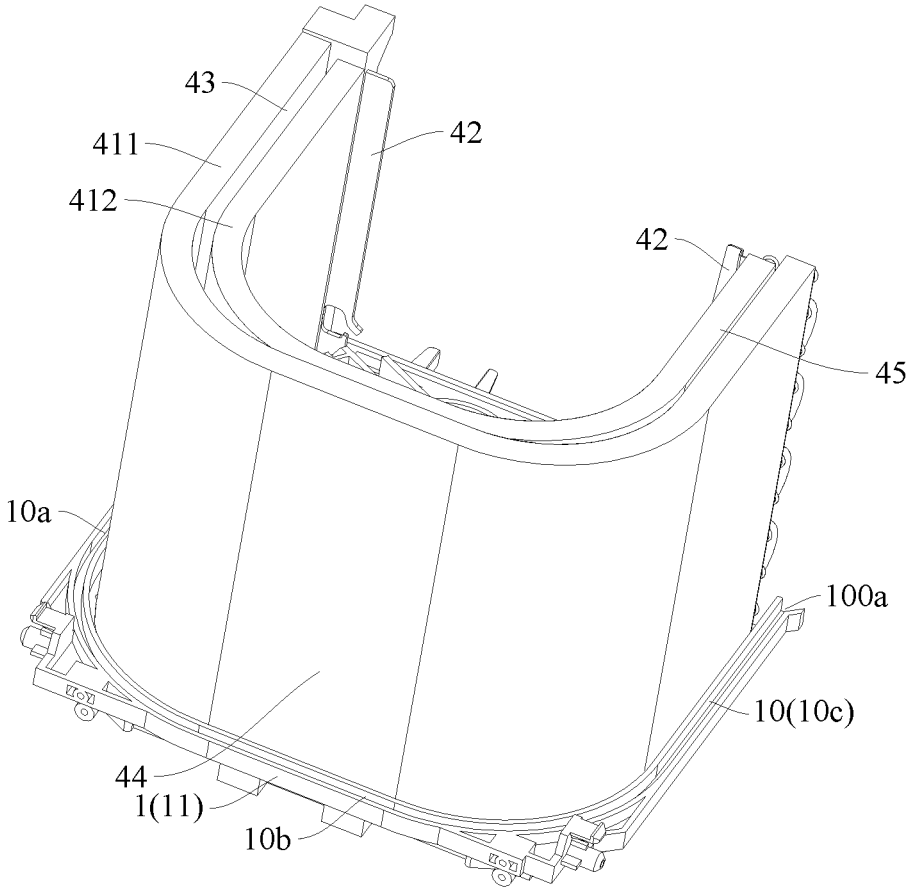
FIG. 8 is a schematic assembly diagram of a motor support and a heat exchanger shown in FIG. 1.

As shown in FIGS. 5, 6, and 8, the first and second guide grooves 10, 20 both extend along the circumferential direction of the housing, and are provided opposite to the three air inlets respectively, such that the three air inlets may correspond to different positions of the first guide groove 10 or different positions of the second guide groove 10 respectively. For example, the first and second guide grooves 10, 20 both extend continuously and uninterruptedly to ensure that the filter screen assembly 3 is mounted smoothly; the first guide groove 10 includes a first groove section 10*a*, a second groove section 10*b* and a third groove section 10*c* arranged along the circumferential direction of the housing, the first, second and third groove sections 10*a*, 10*b*, 10*c* all extend continuously, the second groove section 10*b* is connected between the first and third groove sections 10*a*, 10*c*, and smooth transition is performed between the second groove section 10*b* and the first and third groove sections 10*a*, 10*c* respectively, so as to ensure that the filter screen assembly 3 may smoothly pass through a bending transition position between the first and second groove sections 10*a*, 10*b* and a bending transition position between the second and third groove sections 10*b*, 10*c* in the drawing process; the second guide groove 20 includes a fourth groove section 20*a*, a fifth groove section 20*b* and a sixth groove section 20*c* extending continuously, the fifth groove section 20*b* is connected between the fourth and sixth groove sections 20*a*, 20*c*, and smooth transition is performed between the fifth groove section 20*b* and the fourth and sixth groove sections 20*a*, 20*c* respectively, so as to ensure that the filter screen assembly 3 may smoothly pass through a bending transition position between the fourth and fifth groove sections 20*a*, 20*b* and a bending transition position between the fifth and sixth groove sections 20*b*, 20*c* in the drawing process.

Thus, the first and second guide grooves 10, 20 may be both formed into U shapes extending continuously, such that the filter screen assembly 3 may be provided around the heat exchanger assembly 4, and the filter screen assembly 3 may be conveniently guaranteed to effectively cover the air inlets at the housing after inserted into the first and second guide grooves 10, 20, thus guaranteeing an air filtering effect. The first and fourth groove sections 10*a*, 20*a* are both provided corresponding to the first side wall, the second and fifth groove sections 10*b*, 20*b* are both provided corresponding to the second side wall, and the third and sixth groove sections 10*c*, 20*c* are both provided corresponding to the third side wall.

In some embodiments, as shown in FIGS. 14 and 15, the filter screen assembly 3 extends to have a U shape, and includes a first sub-filter screen 31 and a second sub-filter screen 32 arranged along the circumferential direction of the housing, and the ends of the first and second sub-filter screens 31, 32 adjacent to each other are spliced or overlapped to ensure that the first and second sub-filter screens 31, 32 may effectively cover the air inlets. The first sub-filter screen 31 includes a first part covering the first air inlet and a second part, the second sub-filter screen 32 includes a third part and a fourth part covering the third air inlet, and the second and fourth parts cover the second air inlet, such that the first and second sub-filter screens 31, 32 extend to have L shapes; and at this point, the first sub-filter screen 31 may be drawably inserted into the first and second guide grooves 10, 20 through one end of the first guide groove 10 in the length direction and the corresponding end of the second guide groove 20, the first sub-filter screen 31 has an upper end in a drawing fit with the first guide groove 10 and a lower end in a drawing fit with the second guide groove 20, the second sub-filter screen 32 may be drawably inserted into the first and second guide grooves 10, 20 through the other end of the first guide groove 10 in the length direction and the corresponding end of the second guide groove 20, and the second sub-filter screen 32 has an upper end in a drawing fit with the first guide groove 10 and a lower end in a drawing fit with the second guide groove 20.

Thus, the first and second sub-filter screens 31, 32 are only required to be bent once in the mounting process, which facilitates an improvement of mounting convenience.

Certainly, the present application is not limited thereto; in other embodiments, the filter screen assembly 3 includes a first filter screen portion, a second filter screen portion and a third filter screen portion, the first filter screen portion correspondingly covers the first air inlet, the second filter screen portion correspondingly covers the second air inlet, and the third filter screen portion correspondingly covers the third air inlet; and at this point, the filter screen assembly 3 may be formed into an integrated structure, and is required to be bent twice in the mounting process.

It may be appreciated that the filter screen assembly 3 has certain flexibility and rigidity, and may be drawn and moved in the first and second guide grooves 10, 20 by an external force while accommodating the bending transition of the first and second guide grooves 10, 20.

In some embodiments, as shown in FIGS. 14 and 15, the filter screen assembly 3 includes the first and second sub-filter screens 31, 32 arranged along the circumferential direction of the housing, and the first and second sub-filter screens 31, 32 are arranged symmetrically, such that the first and second sub-filter screens 31, 32 have the same structure, mounting positions of the first and second sub-filter screens 31, 32 may be interchanged, and thus, the first and second sub-filter screens 31, 32 are not required to be distinguished in the mounting process of the filter screen assembly 3, which is beneficial to improving the mounting efficiency.

In some embodiments, as shown in FIGS. 3 and 14, one length end of the filter screen assembly 3 is provided with a limit member 30*a*, and an extension direction of at least a part of the limit member 30*a* and the drawing direction have an included angle which is not 0°, such that when the filter screen assembly 3 is mounted, the limit member 30*a* may be clamped at one length end of the first guide groove 10 and one length end of the second guide groove 20, and a user may conveniently observe whether the filter screen assembly 3 is mounted in place.

In some embodiments, the dehumidifier 100 includes the heat exchanger assembly 4 and the filter screen assembly 3, the heat exchanger assembly 4 is provided at the water pan 2 and located between the water pan 2 and the support body 11, and the filter screen assembly 3 is provided between the air inlet and the heat exchanger assembly 4 in the airflow direction, such that the air inlet, the filter screen assembly 3 and the heat exchanger assembly 4 are matched, for example, "three-side air supply" is realized on the housing; and at this point, the filter screen assembly 3 and the heat exchanger assembly 4 may both extend to have the U shapes, and the filter screen assembly 3 may be provided around the heat exchanger assembly 4, such that the dehumidifier 100 may effectively treat the air.

For example, in the examples of FIGS. 1, 6 and 8, the housing includes a body and a water tank, the body is located on an upper side of the water tank, and the body and the water tank form a mounting space; the first air inlet is formed at a left side of the body, the third air inlet is formed at a front side of the body, the third air inlet is formed at a right side of the body, and an air outlet of the dehumidifier 100 is formed at a top side of the body; and when the dehumidifier 100 operates, the air flows into the housing through the first, second and third air inlets respectively, flows through the filter screen assembly 3, the evaporator 411 and the condenser 412 successively, and then flows to the air outlet through the support body 11, so as to improve environmental humidity. A filter screen mounting opening may be formed at the body, and extends in the up-down direction, and the filter screen assembly 3 may be inserted into the first and second guide grooves 10, 20 through the filter screen mounting opening. A notch is formed at one side (for example, the rear side in FIG. 1) of the water pan 2, a compressor is placed at the notch, and the water pan 2 is provided with a baffle to encircle the compressor to guarantee the air volume.

Other configurations and operations of the dehumidifier 100 according to the embodiments of the present application are known to those skilled in the art and will not be described in detail herein.

In the description of the present application, it is to be understood that terms such as "center," "longitudinal," "transverse," "length," "width," "upper," "lower," "vertical," "horizontal," "top," "bottom," "inner," "outer," "axial," "radial," and "circumferential" should be construed to refer to the orientation as shown in the drawings. These relative terms are for convenience of description and do not require that the present application be constructed or operated in a particular orientation, thus cannot be construed to limit the present application. Furthermore, the feature associated with "first" and "second" may include one or more of this feature explicitly or implicitly.

In the description of the present application, it should be noted that unless specified or limited otherwise, the terms "mounted," "connected," and "coupled" and the like are used broadly, and may be, for example, fixed connections, detachable connections, or integral connections; may also be mechanical or electrical connections; may also be direct connections or indirect connections via intervening structures; may also be inner communications of two elements. The above terms can be understood by those skilled in the art according to specific situations.

In the description of the present specification, reference throughout this specification to "an embodiment," "some embodiments," "exemplary embodiment," "example," "specific example" or "some examples" means that a particular feature, structure, material, or characteristic described in connection with the embodiment or example is included in at least one embodiment or example of the present application. In the specification, the schematic expressions to the above-mentioned terms are not necessarily referring to the same embodiment or example. Furthermore, the described particular features, structures, materials, or characteristics may be combined in any suitable manner in one or more embodiments or examples.

Although embodiments of the present application have been shown and illustrated, it shall be understood by those skilled in the art that various changes, modifications, alternatives and variants without departing from the principle and idea of the present application are acceptable. The scope of the present application is defined by the claims and its equivalents.

What is claimed is:

1. A motor support comprising:

a support body, the support body having a closed ring shape or an open ring shape; and a mounting rack hung below the support body by a connection member and configured to mount a motor, a width of an outer circumference of the mounting rack being smaller than a width of an inner circumference of the support body;

wherein:

the connection member includes a plurality of connection arms arranged at intervals along a circumferential direction of the support body;

each of the plurality of connection arms includes a first part and a second part connected with each other;

a first end of the first part is in contact with the support body, a first end of the second part is in contact with the mounting rack, a second end of the first part and a second end of the second part are in contact with each other;

at the second end of the first part, an angle between a surface of the first part facing towards a central axis of the support body and a surface of the second part facing towards the central axis of the support body is greater than 90 degrees, the central axis of the support body extending in a vertical direction;

the support body is configured to support a condenser of a dehumidifier at a lower side of the support body; and a stopper is formed at the support body and configured to abut against the condenser and includes a first stop member configured to abut against a first side of the condenser in a width direction and a second stop member configured to abut against a second side of the condenser in a height direction, and the first stop member and the second stop member are directly connected with each other to form an L-shaped structure.

2. The motor support according to claim 1, further comprising:

a pillar configured to support a bottom of the support body.

3. The motor support according to claim 1, wherein:

the mounting rack is configured to mount a motor of a fan of the dehumidifier when the motor support is mounted in the dehumidifier;

the support body is further configured to support an evaporator of the dehumidifier at the lower side of the support body; and an upper surface of the support body is provided with at least one of a convex rib or a drainage hole, the convex rib being configured to abut against a housing of the dehumidifier, and the drainage hole running through the support body in an up-down direction.

4. The motor support according to claim 1, wherein:

the mounting rack is configured to mount a motor of a fan of the dehumidifier when the motor support is mounted in the dehumidifier.

5. The motor support according to claim 1, wherein the stopper is one of a plurality of stoppers configured to be arranged at intervals along a length direction of the condenser.

6. The motor support according to claim 1, wherein:

the stopper is one of a first stopper and a second stopper respectively provided at two sides of the first end of the first part of at least one of the plurality of connection arms along the circumferential direction of the support body;

the first stopper is not in contact with the second stopper.

7. A dehumidifier comprising:

a housing including an air inlet;

a fan including a motor;

a water pan provided in the housing; and the motor support according to claim 1, provided in the housing, the motor support being provided above the water pan.

8. The dehumidifier according to claim 7, further comprising:

an evaporator supported at the lower side of the support body;

wherein an upper surface of the support body is provided with at least one of a convex rib or a drainage hole, the convex rib being configured to abut against the housing, and the drainage hole running through the support body in an up-down direction.

9. The dehumidifier according to claim 7, further comprising:

the condenser supported at the lower side of the support body.

10. The dehumidifier according to claim 7, further comprising:

a heat exchanger assembly provided in the housing, at the water pan, and between the water pan and the support body, the heat exchanger assembly including:

a heat exchanger including an evaporator and the condenser sequentially arranged from inside to outside, the condenser being located downstream of the evaporator in an airflow direction; and two side plates provided at two ends of the heat exchanger, respectively, and fixedly connected to the water pan;

wherein the support body is supported at a top of the heat exchanger and fixedly connected to the two side plates.

11. The dehumidifier according to claim 10, wherein:

the heat exchanger assembly includes a first heat exchanging part, a second heat exchanging part, and a third heat exchanging part arranged along a circumferential direction of the housing, the first heat exchanging part being arranged opposite to the third heat exchanging part, and the second heat exchanging part being connected between the first heat exchanging part and third heat exchanging part; and one of the two side plates is provided at an end of the first heat exchanging part away from the second heat exchanging part, and another one of the side plates is provided at an end of the third heat exchanging part away from the second heat exchanging part.

12. The dehumidifier according to claim 10, wherein:

the motor support further includes a pillar between the support body and the water pan to provide support; and the pillar and the side plates are located at two opposite ends of the support body, respectively.

13. The dehumidifier according to claim 7, further comprising:

a filter screen assembly covering the air inlet;

wherein:

a first guide groove is formed at the motor support and a second guide groove is formed at the water pan;

an upper end of the filter screen assembly passes through one length end of the first guide groove and is drawably inserted in the first guide groove; and a lower end of the filter screen assembly passes through one length end of the second guide groove and is drawably inserted in the second guide groove.

14. The dehumidifier according to claim 13, wherein the first guide groove is formed at the support body.

15. The dehumidifier according to claim 13, wherein a depth of the first guide groove and a depth of the second guide groove are greater than 5 mm.

16. The dehumidifier according to claim 13, wherein:

the filter screen assembly includes:

a filter screen skeleton drawably inserted in the first guide groove and the second guide groove; and a filter screen provided at the filter screen skeleton and covering the air inlet;

a difference between a width of the first guide groove and a width of a part of the filter screen skeleton inserted in the first guide groove is greater than or equal to 1 mm and smaller than or equal to 2 mm; and a difference between a width of the second guide groove and a part of the filter screen skeleton inserted in the second guide groove is greater than or equal to 1 mm and smaller than or equal to 2 mm.

17. The dehumidifier according to claim 13, further comprising:

a heat exchanger assembly in the housing, located downstream of the filter screen assembly in the airflow direction, and extending along a circumferential direction of the housing;

wherein:

the air inlet is one of three air inlets arranged along the circumferential direction of the housing and provided opposite to the heat exchanger; and the first guide groove and second guide groove both extend along the circumferential direction of the housing, and are provided opposite to the three air inlets.

18. A motor support comprising:

a support body configured to support a condenser of a dehumidifier at a lower side of the support body; and a mounting rack hung below the support body by a connection member and configured to mount a motor;

wherein:

the connection member includes a plurality of connection arms arranged at intervals along a circumferential direction of the support body, each of the plurality of connection arms includes a first part and a second part connected with each other, a first end of the first part is in contact with the support body, a first end of the second part is in contact with the mounting rack, a second end of the first part and a second end of the second part are in contact with each other, and at the second end of the first part, an angle between the first part and the second part is greater than 90 degrees;

along the circumferential direction of the support body, two sides of the first end of the first part of at least one of the plurality of connection arms are respectively provided with a first stopper and a second stopper;

each of the first stopper and the second stopper includes a first stop member configured to abut against a first side of the condenser in a width direction and a second stop member configured to abut against a second side of the condenser in a height direction, and the first stop member and the second stop member are connected with each other to form an L-shaped structure; and the first stopper is not in contact with the second stopper.

19. A motor support comprising:

a support body, the support body having a closed ring shape or an open ring shape, and the support body being configured to support a condenser of a dehumidifier at a lower side of the support body; and a mounting rack hung below the support body by a connection member and configured to mount a motor, a width of an outer circumference of the mounting rack being smaller than a width of an inner circumference of the support body;

wherein a stopper is formed at the support body and configured to abut against the condenser, the stopper includes a first stop member configured to abut against a first side of the condenser in a width direction and a second stop member configured to abut against a second side of the condenser in a height direction, and the first stop member and the second stop member are directly connected to form an L-shaped structure.

* * * * *